US005606762A

United States Patent [19]

Droeser et al.

[11] Patent Number: 5,606,762

[45] Date of Patent: Mar. 4, 1997

[54] ROLLER BRUSH FOR A SWEEPING MACHINE AND METHOD OF MAKING SAME

[75] Inventors: Walter Droeser; Hans Ekholm, both of Västerås, Sweden

[73] Assignee: Filippa I Västerås HB, Västerås, Sweden

[21] Appl. No.: 256,461

[22] PCT Filed: Jan. 11, 1993

[86] PCT No.: PCT/SE93/00010

§ 371 Date: Sep. 15, 1994

§ 102(e) Date: Sep. 15, 1994

[87] PCT Pub. No.: WO93/14672

PCT Pub. Date: Aug. 5, 1993

[30] Foreign Application Priority Data

Jan. 22, 1992 [SE] Sweden ..... 9200208

[51] Int. Cl.[6] ..... A46B 7/10; A46B 3/16

[52] U.S. Cl. ..... 15/183; 15/179; 15/199; 15/205; 300/21

[58] Field of Search ..... 15/182, 183, 179, 15/198, 199, 197, 202, 204, 205, 180, 181, 191.1; 300/21; 51/293

[56] References Cited

U.S. PATENT DOCUMENTS

| | | | |
|---|---|---|---|
| 2,688,762 | 9/1954 | Vose | 15/205 |
| 2,921,329 | 1/1960 | Peterson | 15/182 |
| 3,002,212 | 10/1961 | Tilgner | 15/199 |
| 3,009,184 | 11/1961 | Dolan | 15/180 |
| 3,036,323 | 5/1962 | Nelson | 15/183 |
| 3,107,382 | 10/1963 | Tilgner | 15/182 |
| 4,077,081 | 3/1978 | Drumm | 15/181 |
| 4,302,863 | 12/1981 | Droeser | 15/183 |
| 4,485,514 | 12/1984 | Droeser | 15/179 |
| 5,383,245 | 1/1995 | Droeser | 15/183 |
| 5,445,438 | 8/1995 | Drumm | 15/183 |
| 5,490,301 | 2/1996 | Droeser | 15/183 |

FOREIGN PATENT DOCUMENTS

| | | | |
|---|---|---|---|
| 561456 | 8/1958 | Canada | 15/182 |
| 657474 | 3/1938 | Germany | 15/199 |

*Primary Examiner*—Gary K. Graham

*Attorney, Agent, or Firm*—Watson Cole Stevens Davis, P.L.L.C.

[57] ABSTRACT

A roller brush and method of making same for sweeping machines for cleaning streets and roads. The brush includes cassettes arranged in brackets around the periphery of a roller and extending in the longitudinal direction of the roller. The cassettes receive spring members, such as radially projecting bristles, the ends of which are brought in contact with ground when the brush is used for cleaning. The cassettes are received in grooves in the brackets. The spring members are bent double around a locking wire which acts to hold the members in the cassettes and which passes through holes in connecting cross walls extending from facing long sides of the cassettes. The connecting cross walls are provided at spaced locations along the cassette thereby defining cells on the cassette. The spaced connecting cross walls act to increase the rigidity of the cassette.

12 Claims, 4 Drawing Sheets

ROLLER BRUSH FOR A SWEEPING MACHINE AND METHOD OF MAKING SAME

TECHINCAL FIELD

The present invention concerns a device in cassettes for spring members for a machine intended, i.a., for cleaning of streets and roads, wherein the cassettes are arranged in brackets which are located around the periphery of a roller and extend mainly in-the longitudinal direction of the roller. The cassettes include spring members, such as radially-projecting bristles, whole ends are brought in contact with the ground by rotation of the roller.

BACKGROUND OF THE INVENTION

A great number of solutions are known for the fastening of cassettes for bristle bunches arranged around the periphery of a bristle roller or roller brush, which in its turn rotatably mounted on a sweeping machine or the like. U.S. Pat. No. 4,302,563 describes a bristle roller including elongated cassettes in which bunches of bristles are arranged in openings along the length of each cassette. Each cassette is accommodated in a groove extending along the length of the bristle roller and is constituted by two facing U-shaped sheet profiles which provide facing openings in which bristle bunches are arranged with radially-projecting bristles. The bristle bunches include spring members which are double bent at the bottom of each bunch around a locking wire, which is arranged underneath the sheet profile located close to the bristle roller and fixed by a loop-shaped projection at the under side of the profile. The cassettes are given a sufficiant rigidity in that the two sheet profiles engage and constitute a closed cross section. A single U-shaped profile open outwardly would have a too low rigidity to be practially used.

Another embodiment of a bristle roller is disclosed in U.S. Pat. No. 4,498,210. In this roller a cassette is arranged in brackets, which in turn are attached upon a longitudinally-extended roller. The brackets provide sliding grooves in which the cassettes are positioned. The spring members in each cassette are arranged along the full extension of the cassette and are double bent around a locking wire extending along the bottom of the cassette. The spring members are kept in the cassette because it is plastically as well as elastically deformed after that the spring members are mounted in a way that the locking wire is kept at the bottom of the cassette and the spring members are jammed along the extension of the cassette. A drawback with cassettes of this design is that the locking wire is not fixed in an exact position sideways or vertically along the extension of the cassette. Cassettes according to this design also are sensitive to water and dirt penetrating into the inner of the cassettes as well as the brackets for the same.

SUMMARY OF THE INVENTION

The object of the present invention is to provide a device in cassettes for spring members for a machine intended, i.a., for cleaning of streets and roads, which do not have the drawbacks which are present in known cassettes. The cassettes according to the invention are arranged in brackets around the periphery of a roller that extend mainly in the longitudinal direction of the roller. Each cassette includes spring members such as radially-projecting bristles, the ends of which are brought in contact with the ground during rotation of the roller. Each cassette includes an elongated bar which can be arranged in facing grooves in brackets extending along the extension of the roller. The spring members are arranged double bent around a locking means extending in the longitudinal direction of the bar. The bar provides a mainly U-shaped cross section including two facing sides and a bottom therebetween. The device according to the invention is characterized in that the two facing sides in the bar are mutually connected by connecting means extending across a section of the bar at a distance from each other along the extension of the bar, by way of which the bar is divided into cells. By the connecting means the U-shaped bar obtains a satisfactory rigidity without being designed with a closed cross section. The dividing into cells permits the spring members to be placed only in some of the cells along the extension of the bar in that way that the spring members in these cells constitute bunches along the extension of the bar.

The locking means can be fixed relative to the connecting means or constitute an integrated part of the same. The locking means is fixed sideways and kept in the bar by contact with the connecting means, which are preferably arranged at the same distances along the extension of the bar. The spring members in the bar, double bent around the locking means extending in the longitudinal direction of the bar, are this fixed.

Preferably the connecting means are constituted by transverse walls extending mainly perpendicularly to the long sides and providing holes for a locking means in the shape of a locking wire extending in the longitudinal direction of the bar. The bar can be manufactured from sheet metal, such that the transverse walls are constituted by lugs which are punched from each long side and folded to each other, preferably in such a way that the lugs are in contact and overlap. Further holes are punched from each long side at each lug in such a way that the holes are congruent as the lugs are folded to each other.

The brackets for the cassettes for spring members are designed in such a way that a duct is constituted between the bottom of the bracket and the bottom of the bar. The bottom of the bar also includes holes over the extension of the bar by which water can be drained from the bar and flow out through the duct in the bottom of the bracket.

Preferably spring members are arranged in all cells along the extension of the bar and preferably in cages, preferably manufactured of plastic, which project above each long side of the bar. Each cage can be constituted from a flat body in an initial position, which after being brought down into the bar, will be endowed with the desired shape of the cage. However each cage also can have a finished shape having a mainly perpendicular lower portion with holes for the locking means in two facing walls and a funnel-shaped, outwardly sloping upper portion, against which the spring members rest when the roller is working.

The long sides of the bar include preferably outwards directed flanges which are in connection with the brackets on the roller of the rotor. The long sides of the bar also can include inwardly directed ridges to which the outermost located spring members can rest in the cases when the bar is not provided with projecting cages. In an alternative embodiment of the invention the bar can be manufactured of plastic and the connecting means are made as cross walls constituting portions of the bar.

During mounting of the spring members in a bar, mainly straight spring members are arranged across the bar at cells which are to be filled with spring members. A depression tool then is caused to move to the spring members and press the same into the cells in the bar endowing a U-shape to the spring members into a position between the holes in the connecting means of the bar and the bottom on the bar. The depression tool can show a groove at its front end parallel with the bar, permitting a locking means, e.g. in the shape of a locking wire, to be inserted through the holes in all connecting means with the depressing tool in a lowered position in that way that the spring members are kept in the cells in the bar. Alternatively a disc-shaped depression tool at first can be caused to press the spring members into the cells in the bar and after that caused to retract from the bar that such the holes will be free for the locking means to be inserted through the holes in the connecting means.

When the spring members are to be placed in a cage constituted by a flat body, the spring members are arranged lying on the body across the bar at cells which are to be filled, after which the depression tool is caused to depress the body as well as the spring members in the bar, at which a cage is constituted and caused to surround the spring members at each cell. When the cage has a finished shape from the beginning, the spring members, temporarily mounted in each cage, is brought into a cell in the bar. In this case the spring members are depressed in the cage keeping the holes in the cage free for the locking means in that way that the locking means can be inserted after that the cage with the spring members are brought down into the bar.

BRIEF DESCRIPTION OF THE DRAWINGS

The invention will be better understood by reference to the enclosed drawings.

DESCRIPTION OF THE PREFERRED EMBODIMENT

Figure 1:
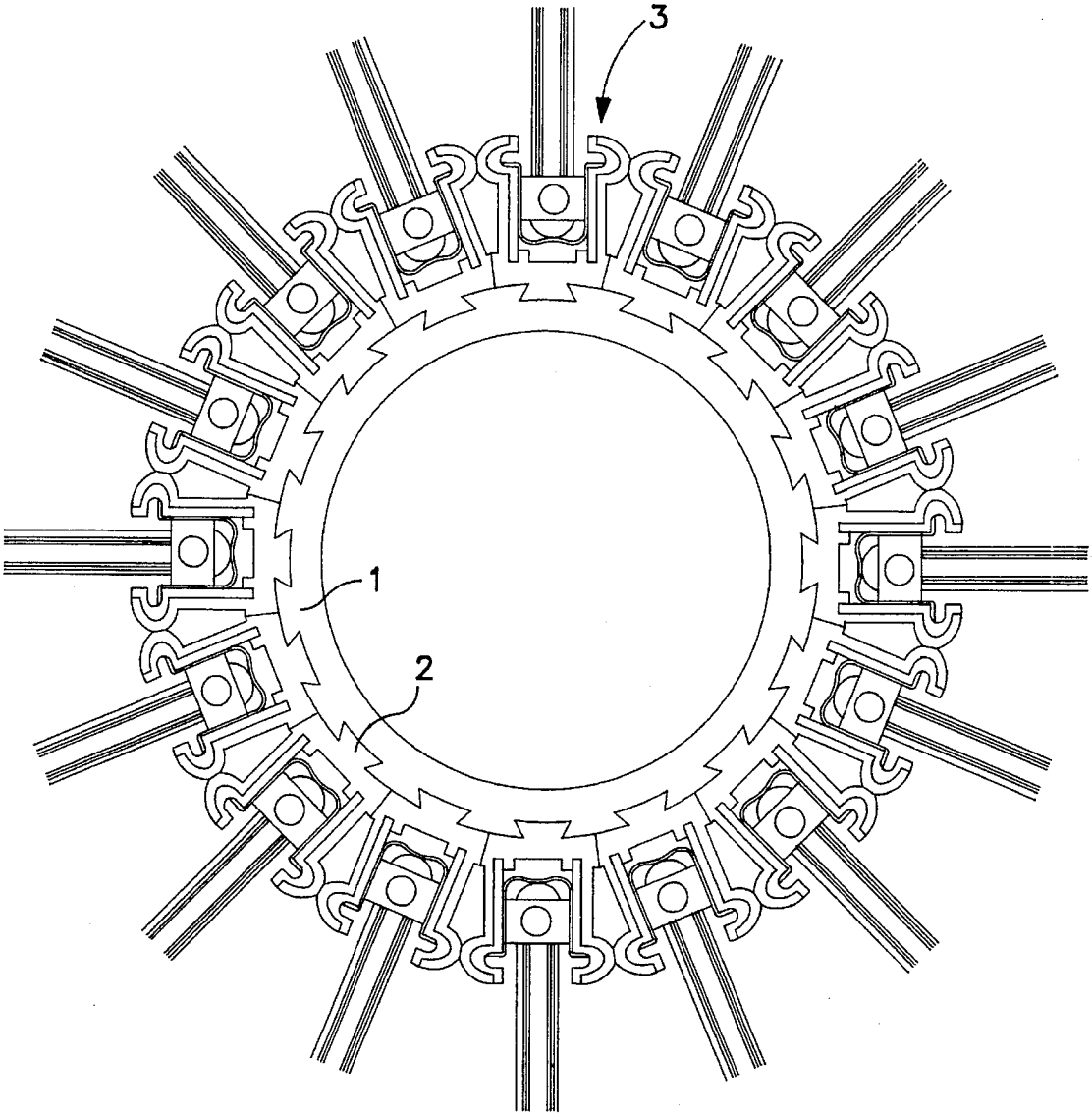
FIG. 1 shows a rotor according to the invention in cross section.
Figure 2:
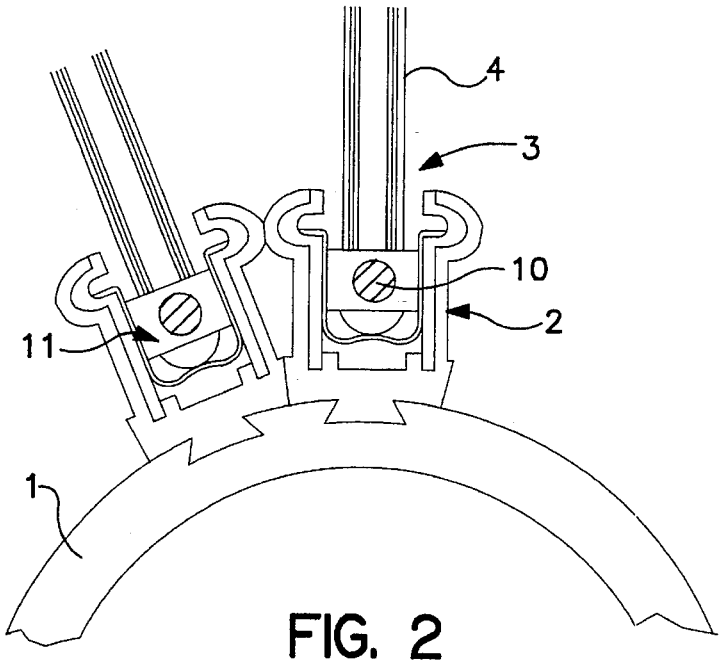
FIG. 2 shows a portion of the rotor according to FIG. 1 enlarged with two brackets and belonging cassettes for spring members.
Figure 3:
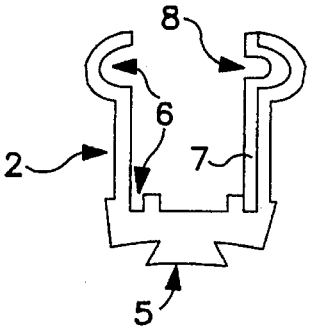
FIG. 3 shows a bracket without the cassette and not fully complete.

A rotor, for, e.g., a sweeping machine, includes and elongated cylindrical roller 1 carrying brackets 2 for elongated cassettes 3 with spring members 4, which cassettes extend along the roller 1 and are arranged next to each other along the periphery of the roller 1. Each bracket 2 provides a mainly U-shaped cross section and is, in this example, manufactured from extruded aluminium and is provided with a longitudinal fastening means in the shape of a dovetail 5, which is intended to be moved into a corresponding groove in the roller 1. In each of the parallel sides of the bracket 2 facing ducts 6 are arranged, by means of which sliding sleeves 7 of plastic are kept. The two mainly parallel sliding sleevs 7 in a bracket 2 provide facing ducts 8 in which a cassette is intended to be mounted.

Figure 6:
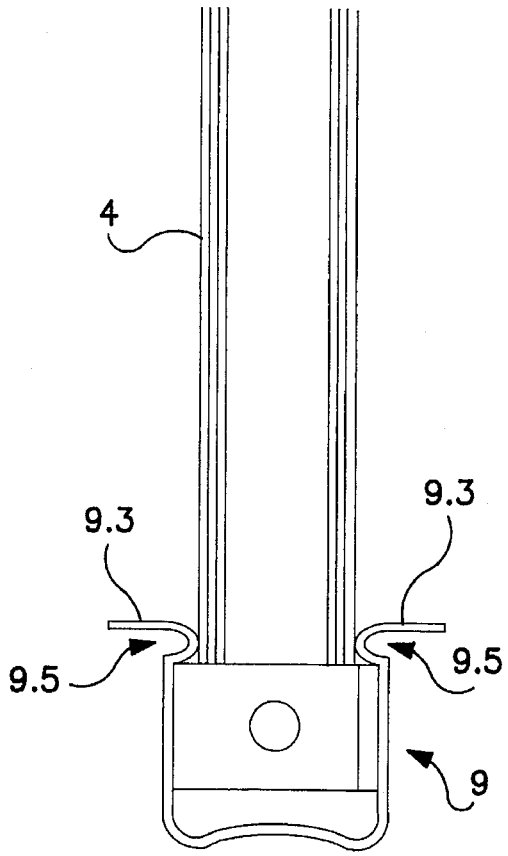
FIG. 6 shows an alternative embodiment of a cassette with spring members mounted.
Figure 7:
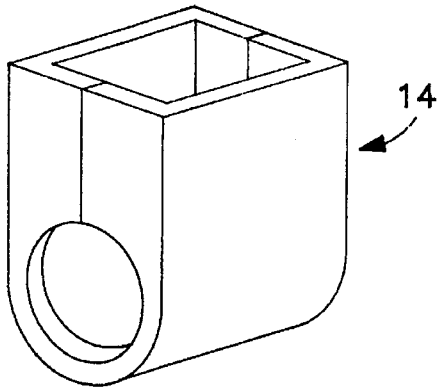
FIG. 7 and 8 show a cage for spring members in a mounted condition and in a condition before mounting.

Each cassette 3 includes a bar 9, which in this example is manufactured of sheet steel, and which, as the bracket 2, has a mainly U-shaped cross section, including facing, mainly parallel long sides 9.1 and between them a bottom 9.2. The spring members 4 are brought down into the bar 9 double bent and arranged around a locking means in the shape of a locking wire 10 of steel extending along the cassette 3. The facing long sides 9.1 of the bar 9 are connected by connecting means in the shape of cross walls 11 extending across the cross section of the bar 9 at a distance from each other along the bar 9, by which the bar 9 is divided into cells 9.4. The cross walls 11 are made in that way that lugs 11.1 are punched from each long side 9.1 and folded to each other, at which also holes 11.2 are punched from each lug 11.1 in that way that the holes 11.2 are congruent when the lugs 11.1 are folded to each other, permitting the locking wire 10 to be brought through the cross walls 11. The long sides 9.1 of the bar 9 provide outwardly directed flanges 9.3 which are in connection with the grooves 8 of the sliding sleeves 7 in the bracket 2. The long sides 9.1 of the bar 9 also can provide inwardly directed ridges 9.5, as shown in an alternative embodiment of the bar 9 in FIG. 6. The bottom 9.2 of the bar 9 includes holes 12 for draining of eventually penetrating water to a duct along the bottom of the bracket 2, from which the water can flow out.

Figure 4:
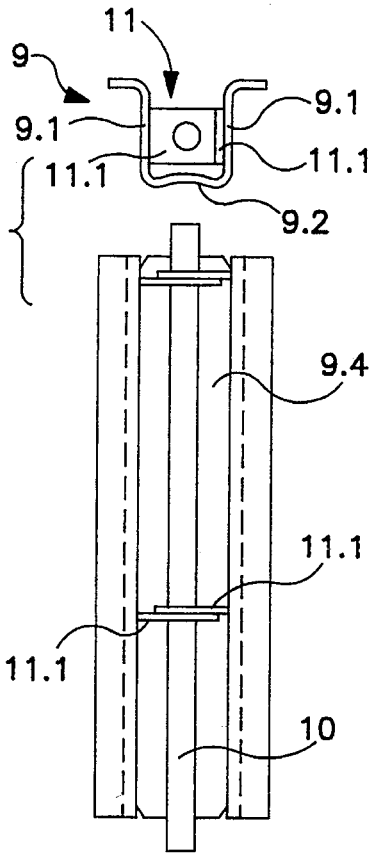
FIG. 4 shows a cassette for spring members partly in a cross section and partly in a direction to its inner space.
Figure 5:
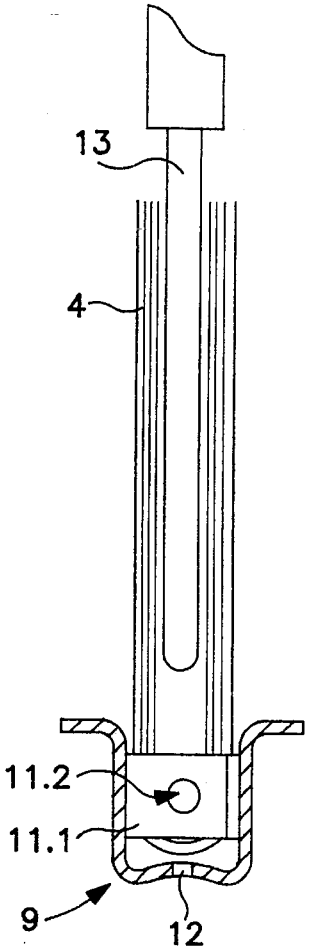
FIG. 5 shows a cassette according to FIG. 4 during mounting of spring members by means of a tool.

When mounting spring members 4 in a bar 9 according to FIG. 4 and 5, straight spring members are placed symmetrically across each cell 9.4 of the bar 9, after which a depression tool 13 in the shape of a disc with a rounded front edge is brought to move against the spring members 4 and down into the bar 9 and at that bend the spring members 4 into a U-shape. In FIG. 5 spring members 4 are shown after being bent in a position in which the depression tool 13 is moved out from the bar 9. The locking wire 10 now can be inserted in the hole 11.2 in each cross wall 11.1 and lock the spring members 4 in the bar 9.

Figure 8:
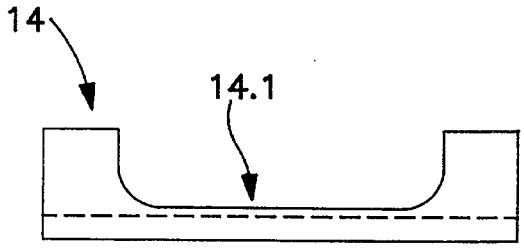
Figure 9:
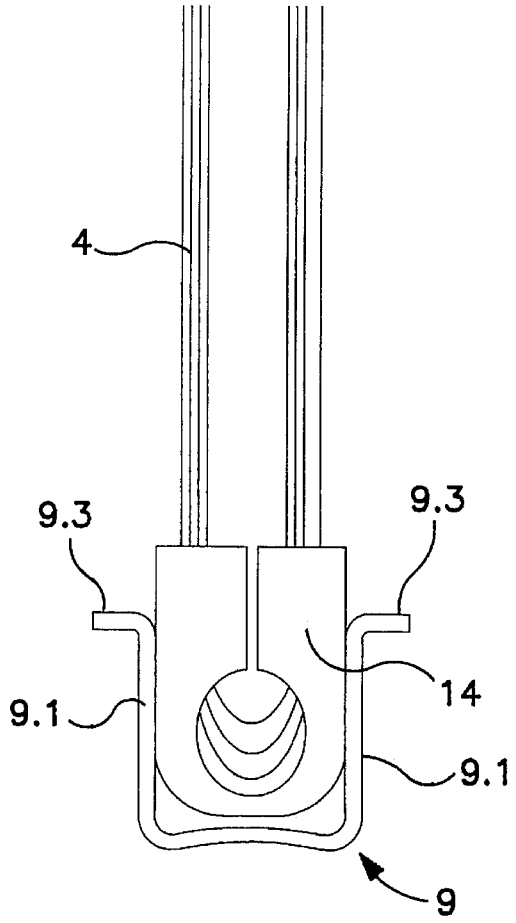
FIG. 9 shows the cage for spring members according to FIG. 7 mounted in a cassette.

In an alternative embodiment of the invention the spring members 4 can be arranged in cages 14, preferably manufactured of plastic, which project from each long side 9.1 of the bar 9. Each cage 14 can be made from a flat body in a starting position as shown in FIG. 8, which after being brought down into the bar 9 will be endowed the desired shape of the cage 14. The body can be provided with notches 14.1 constituting holes for the locking wire 10 after mounting of the cage 14.

Figure 10:
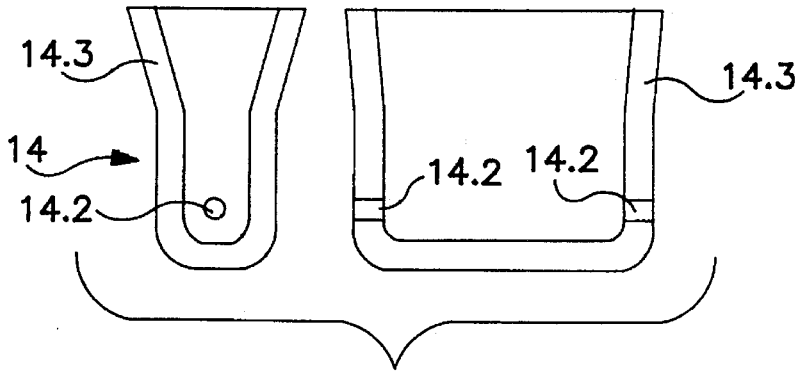
FIG. 10 shows an alternative embodiment of a cage for spring members in cross section and in longitudinal section.

In another alternative embodiment of the invention each cage 14 can have a finished shape from the beginning such as shown in FIG. 10. The already finished cage 14 shows a perpendicular lower part with holes 14.2 for the locking wire 10 in two opposite walls which, after mounting of the cage 14, will be close to each cross wall 11.1 in the bar 9. The cage 14 according to FIG. 10 also shows funnel-shaped outwardly sloping walls 14.3, against which the spring members 4 rest during sweeping with the rotor.

Preferably cages 14, which are preferably made of plastic, are used when spring members 4 are constituted by metal bristles, e.g., steel bristles with a diameter of about 0.45 mm. The cages 14 here constitute mainly a blanking between the long sides 9.1 of the bar 9 and the spring members 4, which can vary in number and thickness. The number of bristles and the material in these spring members 4 are determining for the brushing characteristics of the device. However the cages 14 can be excluded in a bar if the spring members are constituted by relatively thick plastic bristles, e.g., with a rectangular cross section of 1×2 mm. However it is within the scope of the invention to use spring members 4 of plastic bristles as well as metal bristles in the bars 9 with or without the presence of cages 14.

We claim:

1. A roller brush for a sweeping machine for the cleaning of streets and roads, said roller brush comprising: a plurality of cassettes mounted in brackets around a periphery of an elongated roller and extending in a longitudinal direction of the roller, each cassette receiving spring members therein having ends which are adapted to be brought in contact with a ground surface with rotation of the roller, wherein each cassette includes an elongated bar positioned in facing grooves in said brackets extending along the roller, wherein each spring member is double bent around a locking means extending in the longitudinal direction of the bar, and wherein the bar is substantially U-shaped in transverse cross section with two facing long sides and a bottom connecting said sides, wherein the two facing long sides of the bar are mutually and firmly connected together by a plurality of connecting means extending across a transverse cross section of the bar spaced at a distance from each other along the bar, the bar is divided into cells by said spaced connecting means thereby providing the bar with increased rigidity, and wherein each connecting means includes holes therein receiving said locking means, said locking means comprising a locking wire longitudinally extending in the bar through said holes.

2. A roller brush according to claim 1, wherein the connecting means is constituted by cross walls extending mainly perpendicularly to the long sides.

3. A roller brush according to claim 2, wherein the bar is manufactured of sheet metal and the cross walls are formed by lugs punched from each long side and folded to each other and holes are punched from each lug in a way that the holes are congruent when the lugs are folded to each other.

4. A roller brush according to claim 2, wherein the bar is manufactured of plastic and the cross walls are made as integrated parts of the bar.

5. A roller brush according to claim 1, wherein the bottom of the bar includes holes divided along the bar.

6. A roller brush according to claim 1, wherein the spring members are arranged in all cells or some cells only along the bar.

7. A roller brush according to claim 1, wherein the long sides of the bar are provided with outwardly directed flanges which are connected to the brackets on the roller.

8. A roller brush according to claim 1, wherein long sides of the bar provide inwardly directed ridges to which the outermost located spring members in the bar rest.

9. A roller brush according to claim 1, wherein the spring members are provided in cages as a blanking between long sides of the bar and outermost located spring members, wherein the cages can project above the long sides of the bar.

10. A roller brush according to claim 9, wherein each cage is made from a flat body in a starting position, which after being brought down into the bar is endowed the desired shape of the cage.

11. A method for mounting spring members in a bar in a roller brush for a cleaning machine wherein mainly straight spring members are arranged across the bar at cells which are constituted by connecting means connecting facing long sides of the bar and which is to be filled up by said spring members, wherein a disc-shaped depression tool is caused to move against the spring members and press the spring members into each cell in the bar, wherein said disc-shaped depression tool at first is caused to press down the spring members in the cells in the bar, wherein the spring members are given a U-shape in a position between holes in the connecting means and a bottom of the bar, the depression tool after that is caused to move back such that the holes are uncovered, the locking means is brought into the holes in the connecting means, and the depression tool thereafter is removed from the spring members.

12. A method to claim 11, wherein the straight spring members are arranged lying upon a flat body arranged across the bar at cells which are to be filled with spring members, and the depression tool is caused to press down the body as well as the spring members in the bar, wherein a cage is constituted and brought to surround the spring members at each cell.

* * * * *